US009618298B2

(12) United States Patent
Karimullah et al.

(10) Patent No.: US 9,618,298 B2
(45) Date of Patent: Apr. 11, 2017

(54) METHODS AND DEVICES RELATING TO FIREARMS

(71) Applicant: MACFe Enterprises Inc./Les Entreprises MACFe Inc., Ottawa (CA)

(72) Inventors: Mirza Karimullah, Arnprior (CA); R. Paul McKay, Ottawa (CA)

(73) Assignee: MACFe Enterprises Inc./Les Entreprises MACFe Inc., Ottawa (CA)

( * ) Notice: Subject to any disclaimer, the term of this patent is extended or adjusted under 35 U.S.C. 154(b) by 0 days.

(21) Appl. No.: 15/177,097

(22) Filed: Jun. 8, 2016

(65) Prior Publication Data

US 2017/0038186 A1 Feb. 9, 2017

Related U.S. Application Data

(63) Continuation of application No. 14/174,227, filed on Feb. 6, 2014, now Pat. No. 9,404,696.

(51) Int. Cl.

| | |
|---|---|
| ***F41A 15/00*** | (2006.01) |
| ***F41C 27/00*** | (2006.01) |
| ***F41A 7/00*** | (2006.01) |

(52) U.S. Cl.

CPC ..... *F41C 27/00* (2013.01); *F41A 7/00* (2013.01)

(58) Field of Classification Search

USPC ..... 206/3; 42/90, 106; 244/239, 196; 89/45, 89/1.4

See application file for complete search history.

(56) References Cited

U.S. PATENT DOCUMENTS

| | | | |
|---|---|---|---|
| 5,174,482 | A | 12/1992 | Rogers et al. |
| 5,676,241 | A | 10/1997 | Degoix et al. |
| 6,050,464 | A | 4/2000 | Ramsey et al. |
| 6,561,073 | B1 | 5/2003 | Hogmoe |
| 7,025,238 | B2 | 4/2006 | Hughes et al. |
| 7,614,534 | B2 | 11/2009 | Veo et al. |
| 8,555,538 | B2 | 10/2013 | Huffines |
| 2013/0014472 | A1 | 1/2013 | Williams |
| 2013/0104440 | A1 | 5/2013 | Addis |
| 2014/0109455 | A1 | 4/2014 | Chiang |
| 2014/0110443 | A1 | 4/2014 | Ralph |

*Primary Examiner* — J. Woodrow Eldred

(74) *Attorney, Agent, or Firm* — Greer, Burns & Crain, Ltd.

(57) ABSTRACT

A system facilitates one handed manipulation of a service pistol and includes a device having two components and related inserts that allow for single handed loading, cycling, firing, clearing and unloading of semi-automatic pistols. The present device includes a spine; and a retainer attached to the spine wherein the retainer comprises at least a first groove tapering from a first width towards the pivotal attachment between the cover and spine to a second width towards the front edge of the cover.

2 Claims, 11 Drawing Sheets

METHODS AND DEVICES RELATING TO FIREARMS

RELATED APPLICATION

This application claims 35 USC 120 priority from, and is a Continuation of, U.S. Utility patent application Ser. No. 14/174,227, filed Feb. 6, 2014.

BACKGROUND

This invention relates to firearms and more particularly to a magazine holder and a cycling holder, each allowing for quick and efficient cycling of a semi-automatic firearm with one hand.

Semi-automatic, or self-loading, firearms are firearms that perform all the steps necessary to prepare the weapon to fire again after an initial firing, assuming that cartridges remain in the weapon's feed device or magazine. Typically, these steps include extracting and ejecting the spent cartridge case from the weapon's firing chamber, re-cocking the firing mechanism, and loading a new cartridge into the firing chamber. Although automatic weapons and selective firearms do the same tasks, semi-automatic firearms do not automatically fire an additional round until the trigger is released and re-pressed by the person firing the weapon. However, semi-automatic firearms still require the action to be cycled manually before the first shot and when a new magazine is inserted.

Considering a police officer who carries a semi-automatic firearm then under normal circumstances during the performance of their duties, the officer has free and full use of both hands for the drawing, loading, firing, unloading and clearing of their semi-automatic duty pistol. The training an officer receives on firearms handling and safety teaches them to load their pistol at the beginning of each duty shift. This involves removing the pistol from the duty holster, loading a magazine (sometimes called a clip) of ammunition into the pistol, cycling the pistol slide one time while using their primary hand (dominant hand) to hold the pistol grip then using their secondary hand to grip the sides of the pistol slide and move it in a rearward direction to manipulate a round out of the magazine and into the chamber or breach. This slide loading action can be accomplished using the secondary hand and either a "pinch grip"/"sling shot grip" at the rear end of the slide or an "overhand grip" over the top of the slide, behind the breach and pulling the slide mechanism rearward—then releasing the slide forward resulting in a chambered round and the pistol "in battery". After the weapon is loaded for duty it is then placed back into the duty holster and secured.

If a weapon is drawn by the officer during the performance of their duties and is actually discharged, several things can occur. One, when the weapon functions properly, a round of the ammunition is fired and the projectile proceeds out of the muzzle of the weapon in the direction it is aimed at by the officer. The semi-automatic design of the pistol sends the slide back allowing another round to be chambered and ready to fire so long as there is ammunition in the properly seated magazine. Alternatively, there can be a problem such as the ammunition misfiring, or not firing, leaving an un-discharged round of ammunition in the chamber or breach of the weapon which must be cleared out before the weapon can be fired properly. This is referred to by terms such as "live trigger stoppage", "phase one stoppage" and other terms indicating an unintended interruption of fire. To clear such a blockage, the officer must ensure the magazine is seated properly by tapping it with the support hand, cycle the slide of the weapon back to eject the non-fired round of ammunition and allow the weapon's action to load a fresh round of ammunition into the chamber or breach from the magazine. As described previously, this is a two-handed operation.

Another unintended interruption of fire that can occur is a "dead trigger stoppage". This typically occurs when a round or casing fails to eject from the chamber due to faulty ammunition or a damaged extractor. A second round tries to feed into the chamber but is blocked by the initial round/casing that failed to eject. The pressure of the slide trying to fall forward into battery (but stopped by the "double feed") seizes the pistol. As the extractor may not be able to properly grasp either round (the action can now only partially cycle), simply cycling the action will not clear the malfunction. A pistol in this state will not fire. In order to clear the pistol the magazine must be forcefully removed as pressure is holding the rounds in place. Ideally, the slide is placed in the locked back position releasing pressure on the double fed rounds. This allows the magazine to be stripped much easier. Once the magazine is stripped, the officer clears the port to ensure the chamber and magazine well are clear, then inserts a fresh magazine and cycles the action forward resulting in a fully loaded and ready (live round in chamber) pistol. Again, as described previously, this is a two-handed operation, if proper training regimens are followed.

At the end of the officer's duty shift, the service weapon must be unloaded, cleared and visually checked to ensure it is unloaded and then secured appropriately. This is a reversal of the loading process described above where the magazine is removed, the slide cycled to eject any round that might be in the chamber or breach, the slide locked in the open position, an inspection of the chamber/breach conducted to "prove" the weapon unloaded and safe and then the proper securing of the weapon in the holster or carrying case, as dictated by policy/local laws.

However, what does the officer do if their primary or secondary hand is injured, damaged, incapacitated or otherwise occupied in some way to make it impossible to use in the loading, firing, reloading and unloading of their weapon?

Injuries to the primary, or secondary hand of an officer can occur in many different ways including, but not limited to, a struggle with a suspect, a knife wound, a gunshot wound, having the hand stepped on, impacted with a weapon including sticks, rocks, bricks or fixed objects or slammed in between objects such as car doors or structure doors and their frames, among others. The officer's secondary hand can, in addition to be injured, be otherwise occupied during the performance of their duties while holding another object, including but not limited to, a flashlight, a baton, a pepper spray can, a riot shield or the handling of a service dog. They could also be holding down one suspect while another is still considered a threat or could also be shielding a member of the public while still encountering a continued threat from a suspect.

In these cases, current training regimens teach the officer to manipulate their weapon for loading using one hand only. Some police departments train for this situation, others do not. In cases where training is provided, the officer is shown techniques to cycle their weapon using techniques that are less than effective and involve fine motor skills, require improvisation and often deviate from police tactical principles, e.g. generally requiring the officer to become static. As many of these techniques involve less than ideal practices and are time consuming, e.g. many require the officer to seek cover first thereby completely removing them from the fight, no one tactic or system has become widely accepted in contrast to the two-handed manipulations drills.

Accordingly, when the situation arises where an officer must clear a weapon malfunction as described above when using only one hand, a whole new set of problems arise. There are essentially two main techniques taught for clearing malfunctions with one hand in North America. The first for "live trigger" stoppages requires the officer to find a surface of opportunity to ensure the magazine is seated properly then find a surface suitable to balance the front of the weapon (often the sight—leading to other issues) in order to cycle the action rearward. In the second, for "dead trigger" or double feed stoppages as described above, an officer must find a surface suitable to balance the front of the weapon (often the sight—leading to other issues) in order to cycle the action rearward and lock it in place. With the action open and pressure somewhat eased on the rounds in the chamber/breach, the officer must find a hard and sharp surface to strip the magazine from the pistol. This requires focus and thought as this is often a surface of opportunity. With the magazine stripped the officer must ensure the breach, chamber and magazine well are clear. The officer must then find a place to semi-secure the pistol in an improvised position of opportunity, typically behind a leg or partially in a holster as the action is still open. With the pistol semi-secure the officer must then retrieve and try to seat a magazine in the pistol. Only then, with a seated magazine can the officer grasp the pistol and send the slide forward to cycle a round into the chamber. Should the action/slide have cycled forward by accident during the manipulation prior to the seating of the magazine, the officer would be required to find a surface suitable to balance the front of the weapon in order to cycle the action rearward. Placing such pressure on the front sight can affect the alignment of the sights and greatly affect the ability of the pistol to be aimed properly. Pressure on the sight can also damage the front sights or post to a degree where the weapon cannot be aimed at all.

These prior art options involving one handed manipulations are time consuming and can take even a well-trained officer 35-45 seconds under range situations. This does not include the time it could take the officer to seek cover in order to complete these "static" tasks nor their trying to complete these actions whilst protecting an individual, holding a struggling individual, trying to stay under cover, etc. Under these circumstances and others where an officer was trying to complete the above clearing procedures one handed in a situation where they were under fire, involved in a hand to hand confrontation or injured, with stress levels at the highest possible levels, such a procedure could very well take considerably longer. Further, depending on variables such as surfaces in the immediate area, and no standard procedure, there is also limited guarantee of success.

Accordingly, the inventors have established a solution to address the problems associated with one handed manipulation of a service pistol. The "Taelin Tactical System" established by the inventors is based upon two components and their related inserts that form a complete "system" allowing for single handed loading, cycling, firing, clearing and unloading of hand held semi-automatic pistols. The system is adaptable to various types of semi-automatic pistols and other firearms.

Other aspects and features of the present invention will become apparent to those ordinarily skilled in the art upon review of the following description of specific embodiments of the invention in conjunction with the accompanying figures.

SUMMARY

It is an object of the present invention to provide a solution to address problems associated with one-handed manipulation of a service pistol.

In accordance with an embodiment of the invention there is provided a device comprising: a spine; a cover pivotally attached to the spine and operable under action of a user from a first normally closed position and a second open position; a spring connected to the cover and spine holding the cover without a first action of a user in the first normally closed position; a base dimensioned to support a firearm magazine such that the firearm magazine is axially aligned to an axis of the spine; and a pair of retaining arms attached to the spine for retaining the firearm magazine within the device without a second action of the user and releasing the firearm magazine under the second action of the user.

In accordance with an embodiment of the invention there is provided a device comprising: a spine; and a retainer attached to the spine wherein the retainer comprises at least a first groove tapering from a first width towards the pivotal attachment between the cover and spine to a second width towards the front edge of the cover.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1:
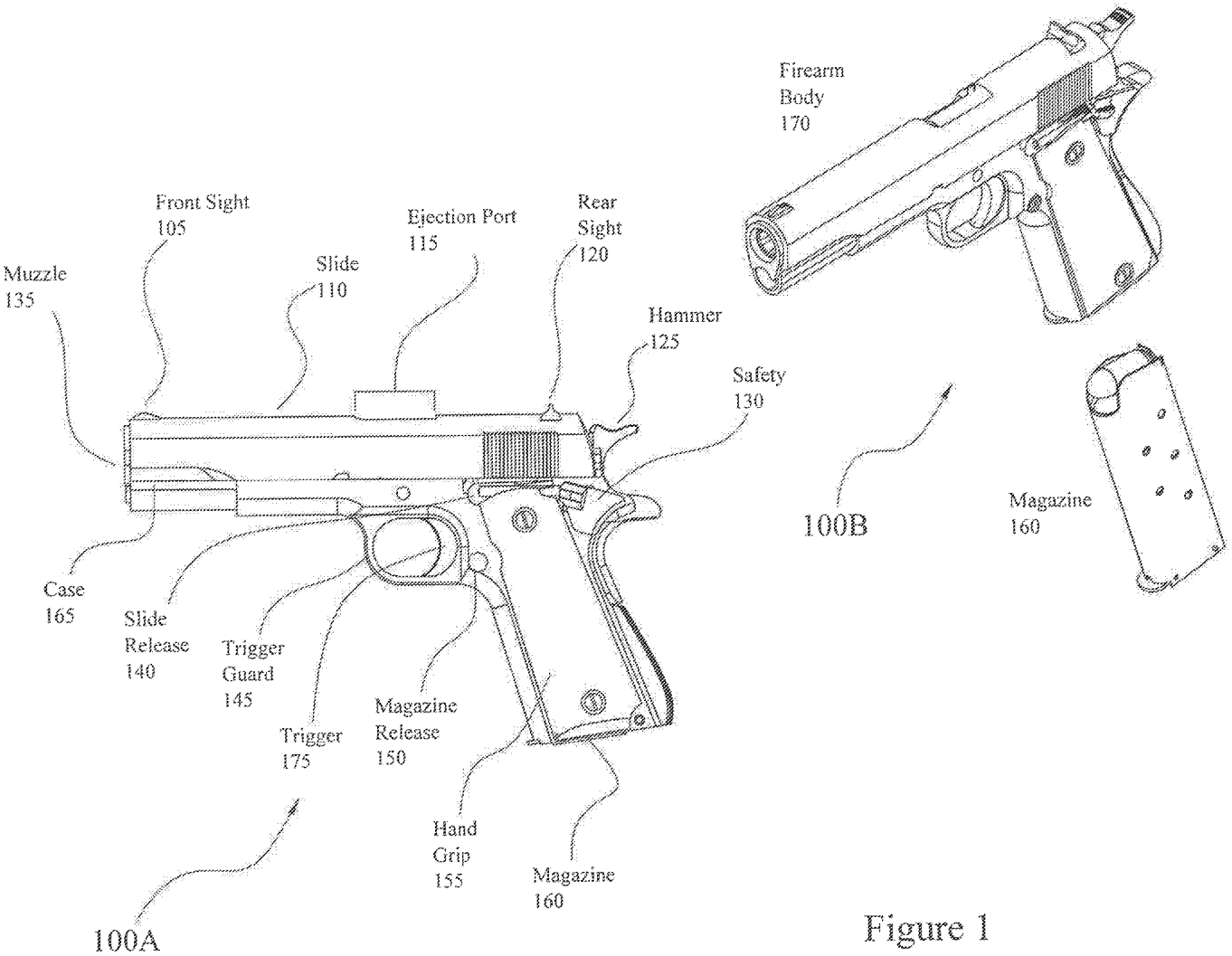
FIG. 1 depicts the different elements of a semi-automatic firearm.

The present invention is directed to firearms and more particularly towards a magazine holder and a cycling holder, each allowing for quick and efficient cycling of a semi-automatic firearm with one hand.

The ensuing description provides exemplary embodiment (s) only, and is not intended to limit the scope, applicability or configuration of the disclosure. Rather, the ensuing description of the exemplary embodiment(s) will provide those skilled in the art with an enabling description for implementing an exemplary embodiment. It being understood that various changes may be made in the function and arrangement of elements without departing from the spirit and scope as set forth in the appended claims.

As described below in respect of FIGS. 2 through 9 the "Taelin Tactical System" (hereinafter TTS) established by the inventors is based upon two components and their related inserts that form a complete "system" allowing for single handed loading, cycling, firing, clearing and unloading of hand held semi-automatic pistols. The TTS is adaptable to various types of semi-automatic pistols and other firearms and comprises a MAGRET 300 (MAGRET) and the Slide CYCLER (CYCLER). These, may within an embodiment of the invention, be designed so that they can be worn on a regulation police style or military duty holster, a plain clothes 1½" wide dress belt or attached to a Modular, Lightweight, Loadbearing, Equipment (MOLLE) tactical system vest. These systems can also be mounted to police tactical ballistic or riot shields, armoured cars or any surface where a firearm could be in use nearby.

The MAGRET 300 (MAGRET) permits one handed access to a fully loaded magazine of ammunition held in an upright position, facing forward, where the officer uses the butt of their service weapon to flip up the spring (or lever/friction) loaded protective cover/lid, places the handle of the weapon directly over the loaded magazine (where it naturally will want to fall), slides the weapon down over top of the magazine, tilts or rotates the magazine out of the holder while continuing the downward motion thus loading the pistol. The user then taps/seats the magazine on the top of the spring loaded protective clip cover/lid, to give the officer a fully loaded weapon in just a few seconds.

The CYCLER then allows the officer to place the muzzle of the weapon in the gross opening groove of the CYCLER and push downward. The groove narrows, catching the slide safely allowing the pistol to load a round of ammunition into the chamber of the weapon to easily provide the officer with a ready-to-fire weapon. This motion is completed quickly, smoothly and in an ergonomically economical, flowing manner. This system is based on tactile feedback (feel) and a user (who is familiar with a semi-automatic pistol) can become proficient with very little practice. The TTS is designed to provide tactile feedback (the feel) consistent with two handed operation thus promoting a familiarity when using the system.

Referring to FIG. 1, there are depicted in first and second views 100A and 100B the different elements of a semi-automatic firearm. As depicted in second view 100B a firearm generally comprises in assembled state a firearm body 170 and a magazine/clip 160. The firearm body 170 as depicted in first view 100A comprises a front sight 105, a slide 110 which must be cycled to load the first bullet (shell) or clear a live round jam by moving it relative to case 165 and hand grip 155, an ejection port 115 through which spent bullets (shells) are ejected, a rear sight 120, and a hammer 125. There is also a safety 130, which may be for left handed user, right handed user, or a pair for one-for-all-users. Additionally, there are slide release 140, trigger guard 145, trigger 175, and magazine release 150 which releases the loaded magazine/clip allowing it to be replaced with a full or partially loaded magazine or stored without a magazine/clip.

Figure 2:
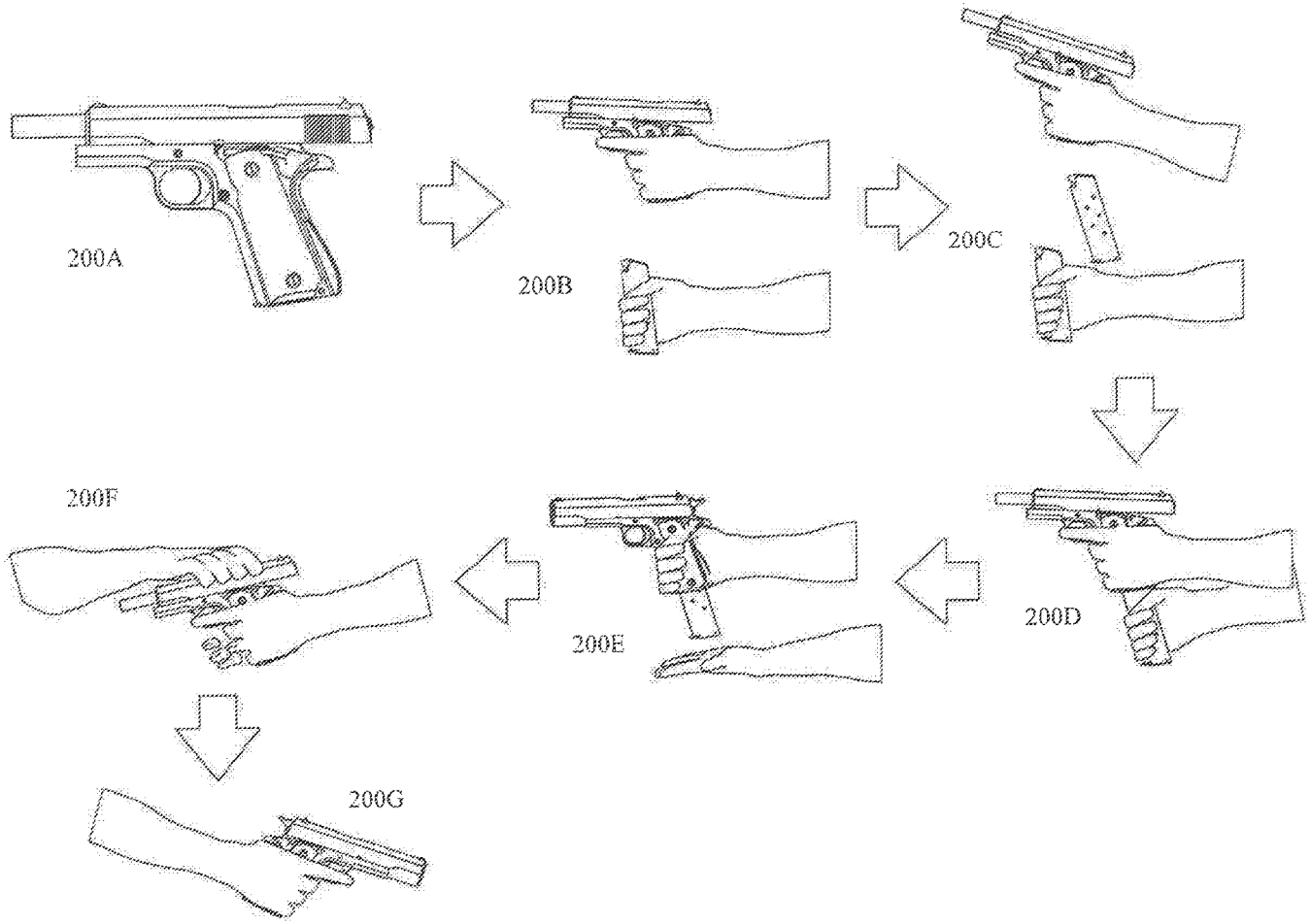
FIG. 2 depicts the two-handed procedure for loading a new magazine for a semi-automatic firearm.

FIG. 2 depicts the two-handed procedure for loading a new magazine for a semi-automatic firearm. These are depicted as:

Step 200A—Identify the Need: An emergency reload or standard reload is needed when you have spent all the rounds from your magazine 160 and your slide 110 is locked back Step 200B—Get Fresh Magazine: Grab a fresh magazine 160 (likely from a magazine pouch) after the slide has locked back on an empty magazine 160, and move the fresh magazine 160 toward the gun.

Step 200C—Eject the Empty Magazine 160: Be sure not to lose your old magazine 160, and bring your new magazine 160 into place below the magazine 160 opening. With well-trained users these should essentially pass each other during the reloading close to the bottom of the firearm. Ejecting the magazine 160 requires the user push the magazine release 150 and having the bottom of the hand grip 155 clear to allow the magazine 160 to come out.

Step 200D—Insert the Magazine 160: Place the rear of the magazine 160 against the rear of the magazine 160 well of the firearm body 170, align the two, and with some force (though there should be little resistance) insert.

Step 200E—Seat the Magazine 160: Using the heel of their palm the user must give the magazine 160 a tap such that the magazine 160 clicks into place within the firearm body 170.

Step 200F—Cycle the Slide 110: Placing one hand over the top of the slide 110 and holding the firearm grip 155 pull the slide 110 back towards their chest. Care must be exercised at this point to ensure that the user's finger(s) are not caught in the slide opening, or that anything else such as clothing might get caught.

Step 200G—Release: Now the slide is released, so it can go forward with full force. This will seat the next round in the chamber, preparing it for discharge.

Figure 3:
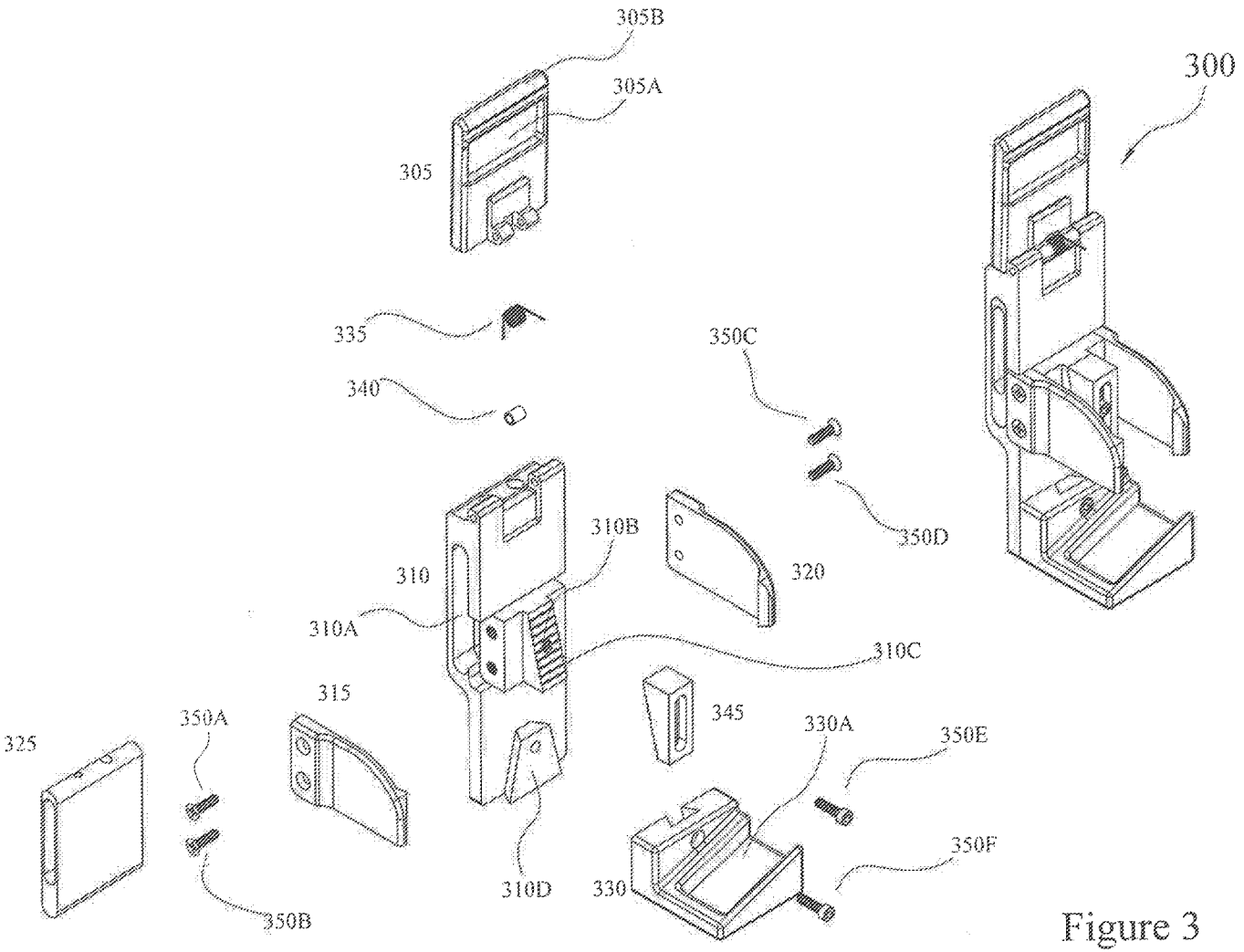
FIG. 3 depicts an exploded assembly for a magazine/clip retainer (MAGRET) according to an embodiment of the invention.

FIG. 3 depicts an exploded assembly for a magazine/clip retainer (MAGRET) 300 according to an embodiment of the invention. The MAGRET 300 is assembled upon a spine 310, which may for example be made from impact resistant Delrin™, polyoxymethylene, although other impact resistant polymers, fiber reinforced polymers, etc. may be employed as well as lightweight composites and metals, e.g. aluminum. Beneficially, in some circumstances selection of Delrin™ or another plastic material also permits the use of the system in cold weather climates where metals would stick to exposed flesh as well as potentially scratch and damage parts of the weapon during use.

The spine 310 is designed to permit attachment to a standard police or military style duty belt measuring approximately 2¼" high and ¼" thick through a slot 310A, for example, or alternatively by deploying an alternative spine, insert, attachment and/or conversion for use on a plain clothes dress belt, such as the BlackHawk CQC carbon fibre belt model 4113PBK for example measuring approximately 1½" high and ¼" thick, or for attachment on a MOLLE style tactical vest such as currently in use by law enforcement and military around the world. It would be evident that through variations of an insert 325 which may be retained within the spine 310 through screw fittings (not shown for clarity) that the spine 310 may be fitted to a wide variety of belts, straps etc. Alternatively, the slot 310A discretely and/or in combination with other mounting fixtures not shown for clarity may allow for the spine 310 to be mounted through a variety of mounting fixtures such that the MAGRET 300 may be easily adapted to mount onto not only a wide range of vests, protective wear, equipment etc. but also that the MAGRET 300 may also be attached to a variety of surface mounting systems, e.g. the inside of a police shield or an interior surface of an urban protection vehicle.

The spine 310 and insert 325 may themselves be secured to the duty belt, for example by using two 8-32 socket head set screws for the Police 2¼" duty belt for example, or one 8-32 socket head set screw for the plain clothes duty belt rather than relying upon a friction fit or interference fit so that the spine stays in position and does not shift when the officer comes to apply pressure/force to it. The spine 310 and other components of the MAGRET 300 may be coloured black, for example, to blend in with current material colouring of tactical and police duty equipment as well as providing long service life and durability. However, the colour can be adapted to match operational environment included, but not limited to, pixelated patterns etc. as commonly found in military camouflage. As the TTS is based upon tactile feedback (feel) such that the user can quickly landmark and use the system this makes finding the unit based on color flexible according to the environment.

The spine 310 has two flexible arms, first and second arms 315 and 320 respectively, attached to the right and left sides respectively as viewed from the front which orient and lock the ammunition clip (magazine 160) in position within the MAGRET 300, leaving it standing upright, straight and facing forward. The first and second arms 315 and 320 respectively are designed to flex outward whenever a magazine 160 is rotated into or out of the retainer and flex back into normal position when the magazine 160 is in place thereby holding it correctly oriented and secure. The top surfaces of each MAGRET 300 arm are rounded downward toward the outer edges so that a downward motion for loading the magazine 160 can still occur as the magazine 160 undergoes simultaneous rotational motion during its removal from the MAGRET 300. Accordingly, the user in loading a new magazine can place the well within the firearm handle 155 over the top of the magazine 160 such that subsequently as they begin pushing downwards they pivot the firearm from their body so that the magazine is removed from the first and second arms 315 and 320 respectively and continues insertion into the firearm.

The first and second arms 315 and 320 respectively of the MAGRET 300 may each be secured to the spine 310 with two 6-23 flat head machine screws on each side to permit the arms to be replaced quickly and easily should they become damaged through use or abuse. These are depicted as first screw pair 350A/350B and second screw pair 350C/350D respectively. The first and second arms 315 and 320 respectively are also replaceable to permit exchanging of these MAGRET 300 arms for retaining arms suited to a different width of magazine 160, for example. Accordingly, the first and second arms 315 and 320 respectively can be quickly and easily changed such that a common spine is employed. Similarly, an array of spines 310 may be disposed as a single unit, an array of multiple units, or an array of discrete units wherein different spines 310 are provided with different first and second arms 315 and 320 respectively (and possibly base 330) allowing multiple magazines 160 to be stored and rapidly accessed, e.g. upon the inner surface of a lid of a police cruiser trunk, allowing multiple firearms to be accommodated. In such instances, a colour coding or text identifier may be applied to the first and second arms 315 and 320 respectively or the outer exposed surface of the cover 305.

Between the first and second arms 315 and 320 respectively of the MAGRET 300 and attaching to the spine 310 is an adjustable spacer 345, or standoff, which can be quickly changed to accommodate different thicknesses of magazines 160 from various firearms manufacturers much like the first and second arms 315 and 320 respectively provide for accommodation of different magazine 160 widths. To fit and adjust the MAGRET 300 to a different size magazine 160, a 6-32 socket head set screw 350E used to attach the spacer 345 to the spine 310 is loosened on the spacer 345. The spacer 345 forms a second part of an assembly of two pieces, the other being element 310C forming part of the spine 310 which are each stepped in increments of approximately 0.031". The spacer 345 can be adjusted upwards or downwards before being screwed into position via screw 350E. The spacer 345 may be visually slid until the surface of the spacer 345 just touches the inner surface of the magazine 160 when held in position inside the MAGRET 300. Once the socket head screw is re-tightened, the spacer 345 is locked into position and properly supports the inside edge of the magazine 160 from movement.

This spacer 345 also performs the function of a standoff to ensure that the inside edge of the magazine 160 is far enough away from the spine 310 and protective cover 305 so as not to catch the officers' fingers on the spine 310 or cover 305 when performing the loading function. Alternative means of providing adjustably positioned spacer 345 may be envisioned in other embodiments of the invention whilst in other embodiments the spacer 345 may be integrally formed with the spine 310 such that the MAGRET 300 is dimensioned and not adjustable. Such a design may be employed for example where a single firearm is deployed for police officers within a police force and only a single magazine 160 design is employed. In a similar manner, as different first and second arms 315 and 320 respectively may be employed colour coded and/or labelled for particular firearms 170/magazines 160 then the same may be applied to spacer 345. Optionally, spacer 345 may be varied in thickness and fixed in the same position rather than being slidable.

The top of the magazine 160 and the ammunition rounds within it are protected when held inside the MAGRET 300 by a spring loaded protective magazine cover 305, or lid, which is attached to the spine 310 and held in place with a ⅛" diameter hinge pin approximately 1¾" long whilst spring loading is provided via spring 335. Fitting over the hinge pin and within the inner diameter of spring 335 is hinge pin cover 340. The underside of this protective cover/lid may have a machined relief 305A in it that has been filled with a soft, open cell foam which protects the top of the clip and rounds of ammunition from damage. Alternatively, a soft material, such as rubber, foam, etc. may be applied to the underside of the cover 305. On the underside of the protective magazine cover 305, running from left to right on the front edge of the cover 305, is a slot 305B machined into the surface to permit positive catching of the protective cover/lid by the bottom edge of the hand grip 155 when the firearm is used to flip the cover 305 open to access the magazine 160 within the MAGRET 300 for loading. The protective cover 305 also acts as a deflector to stop the top of the magazine from catching on clothing or equipment or being grabbed and pulled out of the MAGRET 300 during a struggle by the officer. Further, protective cover 305 may provide a resilient flat surface for the officer to push the bottom of the magazine 160 against to ensure that it is seated and secured within the hand grip 155.

The base 330 of the MAGRET 300 has been designed to be changeable from one firearm magazine 160 to another by removing one 6-32 socket head cap screw, then sliding the base 330 upward to disengage from tongue 310D of spine 310. Alternative fixing and/or mounting means may be employed without departing from the scope of the invention. The base 330 used on any particular magazine is determined by the firearm manufacturer of the firearm the officer will be using. Each manufacturer's weapon magazine is slightly different from another even though they follow similar design and manufacturing principles. For example, the size of the magazine base may vary, the angle of the magazine base relative to the magazine body may vary, and the overall length may also vary. As a result, the base 330 for any given spine 310 may be specifically designed to accommodate and fit a particular weapon. For example, a base 330 may be designed specifically for a Smith & Wesson (S&W) 500. Each base 330 is designed and may be manufactured in both a right hand (RH) and left hand (LH) version to suit both right and left handed shooters so that independent of hand configuration installed, the nose of the ammunition rounds loaded into a magazine 160 face forward when mounted on the officers duty belt, to allow for correct loading of the weapon.

In order for the MAGRET 300 base 330 to handle the stresses and forces exerted on it during the loading process, a compound dovetail design is depicted within FIG. 3 which causes the base 330 to press into and hold tighter to the groove 310D of the spine 310 as more force is exerted on it. The socket head cap screw retains the base 330 in place and stops it from falling off the spine 310. In the case of the S&W model 5946 the base 330 also incorporates an angle of approximately 18° towards the rear of the base 330 which makes use of gravity to push the clip downward and backward in the base 330 thereby holding it securely in position and spreading out any forces exerted on the base 330, through the magazine 160, during the loading process. This 18° angle represents the angle of the firearm handle 155 relative to the perpendicular of the slide for an S&W model 5846 firearm. This angular dimension for the MAGRET 300 may differ for each model of firearm it is adapted to.

The MAGRET 300 base 330 is also designed to have a tolerance around the actual base 330 of the clip itself in a pocket 330A to permit the clip to be placed into the base 330 and then rotated into position and locked in by the first and second retainer arms 315 and 320 respectively without catching on the base 330 pocket edges. Each MAGRET 300 base 330 may be engraved/cast on the underside with the angular information for the base 330, manufacturers name and weapon model number as well as the hand of orientation (i.e.: right hand RH and left hand LH).

Figure 4:
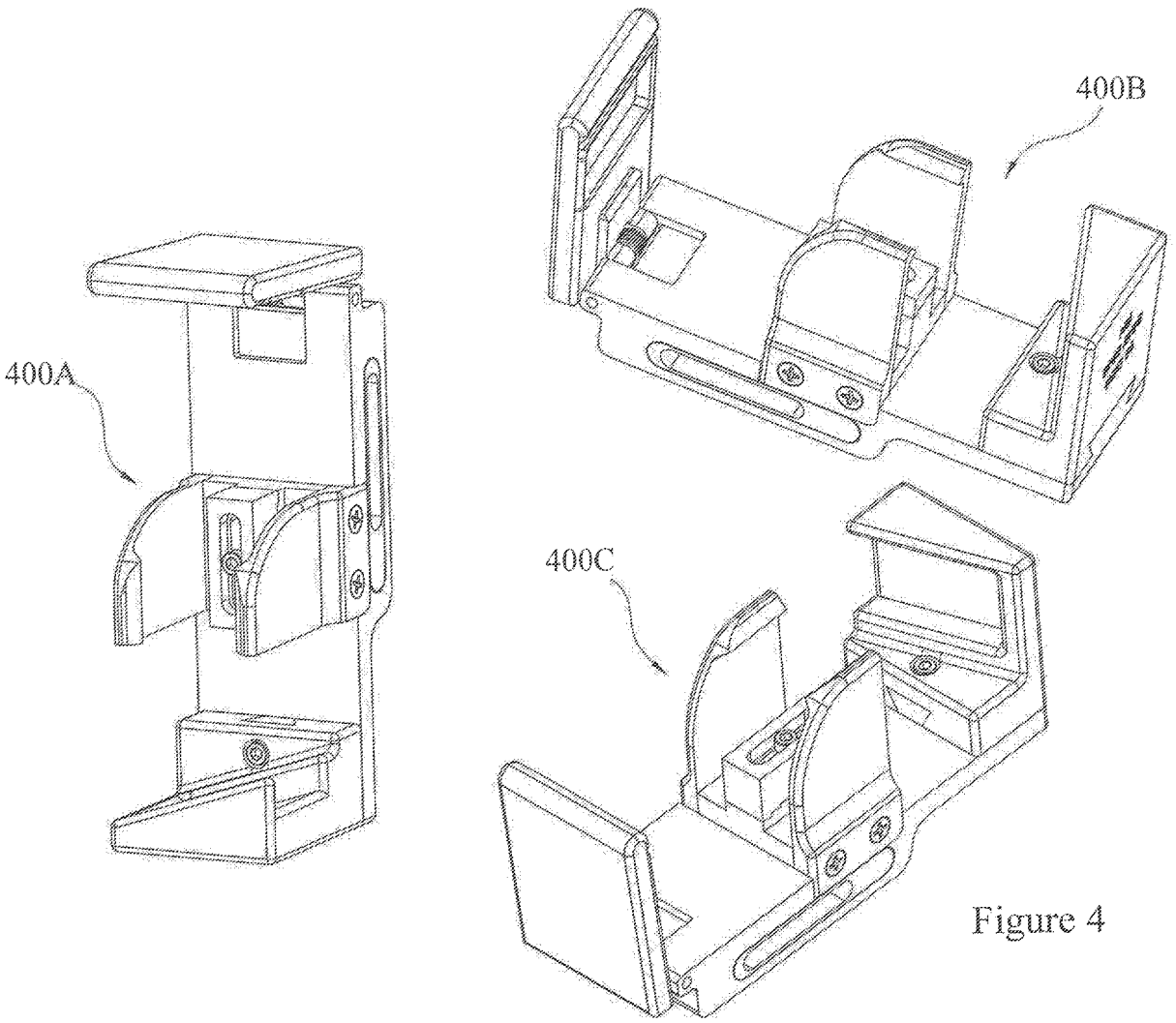
FIG. 4 depicts a MAGRET according to an embodiment of the invention in a closed position without magazine/clip inserted.

Referring to FIG. 4 there are depicted first to third views 400A to 400C respectively for a MAGRET according to an embodiment of the invention in a closed position without magazine 160 inserted. Such a MAGRET being, for example, MAGRET 300 such as described supra in respect of FIG. 3.

Figure 5:
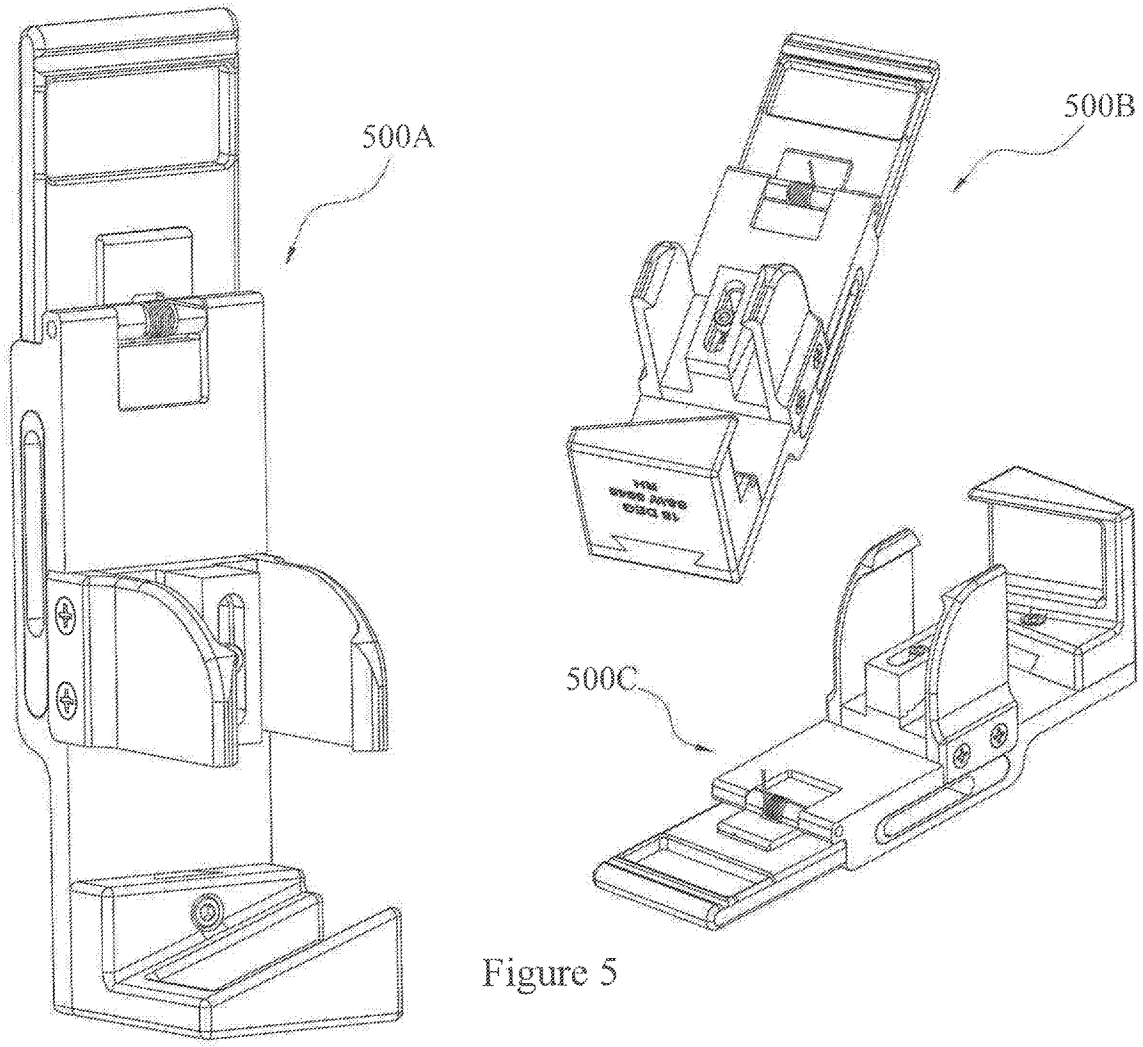
FIG. 5 depicts a MAGRET according to an embodiment of the invention in an open position without magazine/clip inserted.

Referring to FIG. 5 there are depicted first to third views 500A to 500C respectively for a MAGRET according to an embodiment of the invention in an open position without magazine 160 inserted. Such a MAGRET being, for example, MAGRET 300 such as described supra in respect of FIG. 3.

Figure 6:
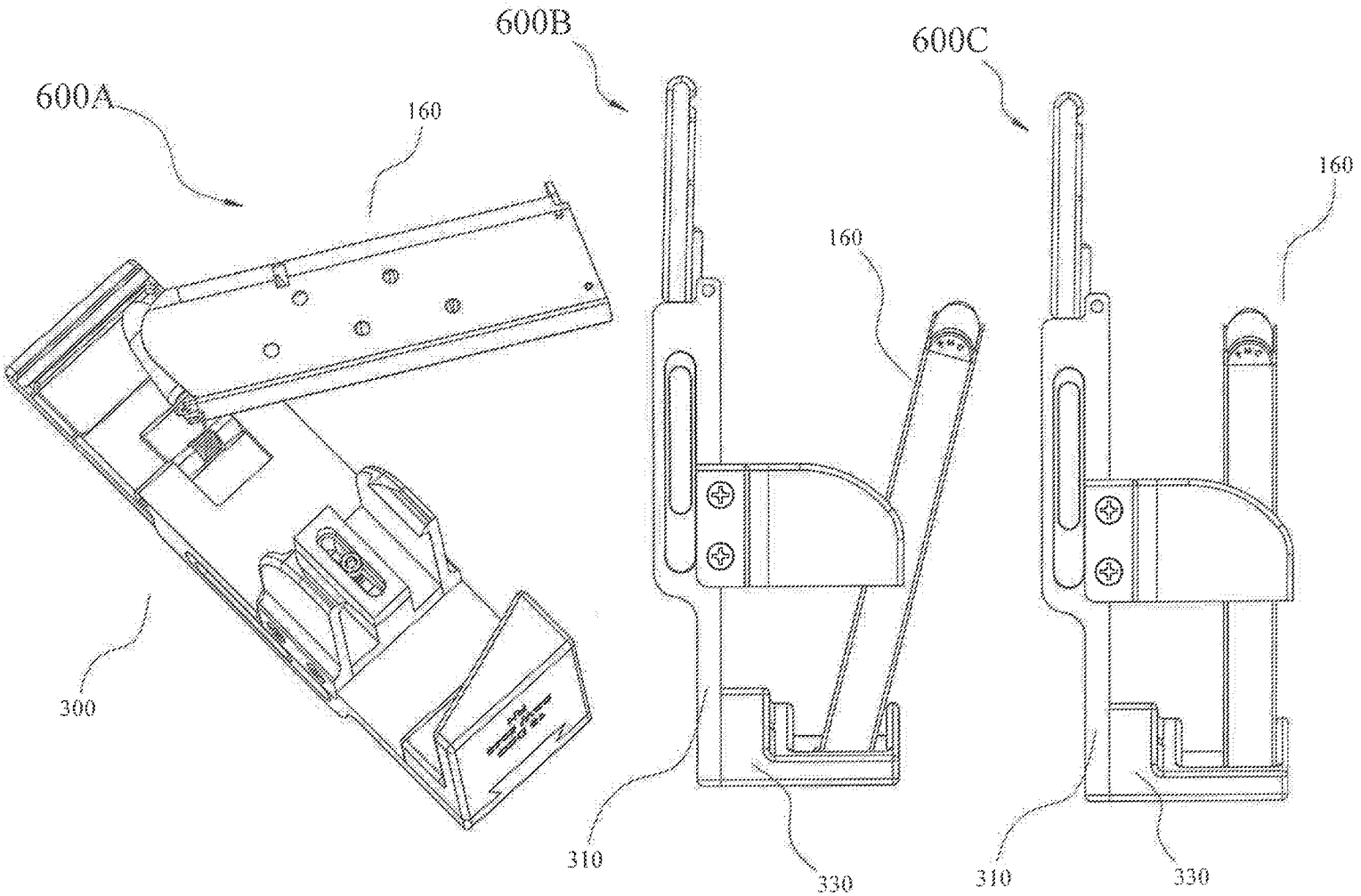
FIG. 6 depicts a MAGRET according to an embodiment of the invention in unassembled and assembled views in open position with magazine/clip.

Referring to FIG. 6 there are depicted first to third views 600A to 600C respectively for a MAGRET according to an embodiment of the invention in an open position with magazine 160. Such a MAGRET being, for example, MAGRET 300 such as described supra in respect of FIG. 3. In first view 600A the magazine 160 is shown unassembled from MAGRET 300 whereas in second view 600B the magazine 160 is depicted tilted such as it would be during insertion into a firearm as the officer pushes the firearm down and pivots it away from the MAGRET 300 spine 310 and base 330. In third view 600C the magazine 160 is depicted mounted such as it would be during normal storage within the MAGRET 300 wherein it is seated within the base 330 and the magazine 160 is parallel to the spine 310.

Figure 7:
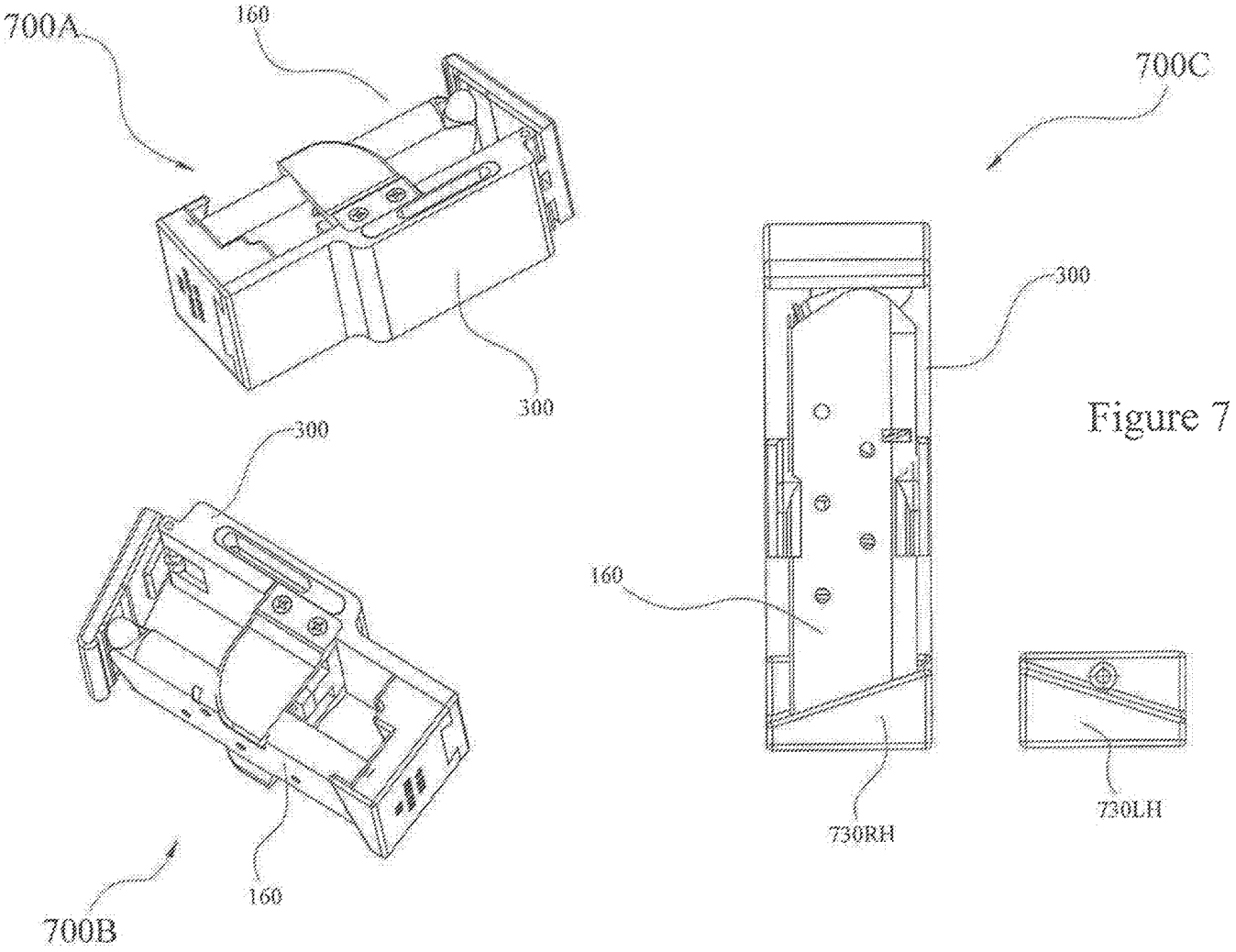
FIG. 7 depicts a MAGRET according to an embodiment of the invention in unassembled and assembled views in closed position with magazine/clip.

Referring to FIG. 7 there are depicted first to third views 700A to 700C respectively for a MAGRET according to an embodiment of the invention in a closed position with magazine 160. Such a MAGRET being, for example, MAGRET 300 such as described supra in respect of FIG. 3. In first and second views 700A and 700B respectively the magazine 160 is shown assembled within the MAGRET 300 from rear and side perspectives. In third view 700C the magazine 160 is depicted mounted within the MAGRET 300 from the front with the lid 305 closed and the magazine 160 seated within the RH base 730RH. Also depicted discretely is LH base 730LH.

Figure 8:
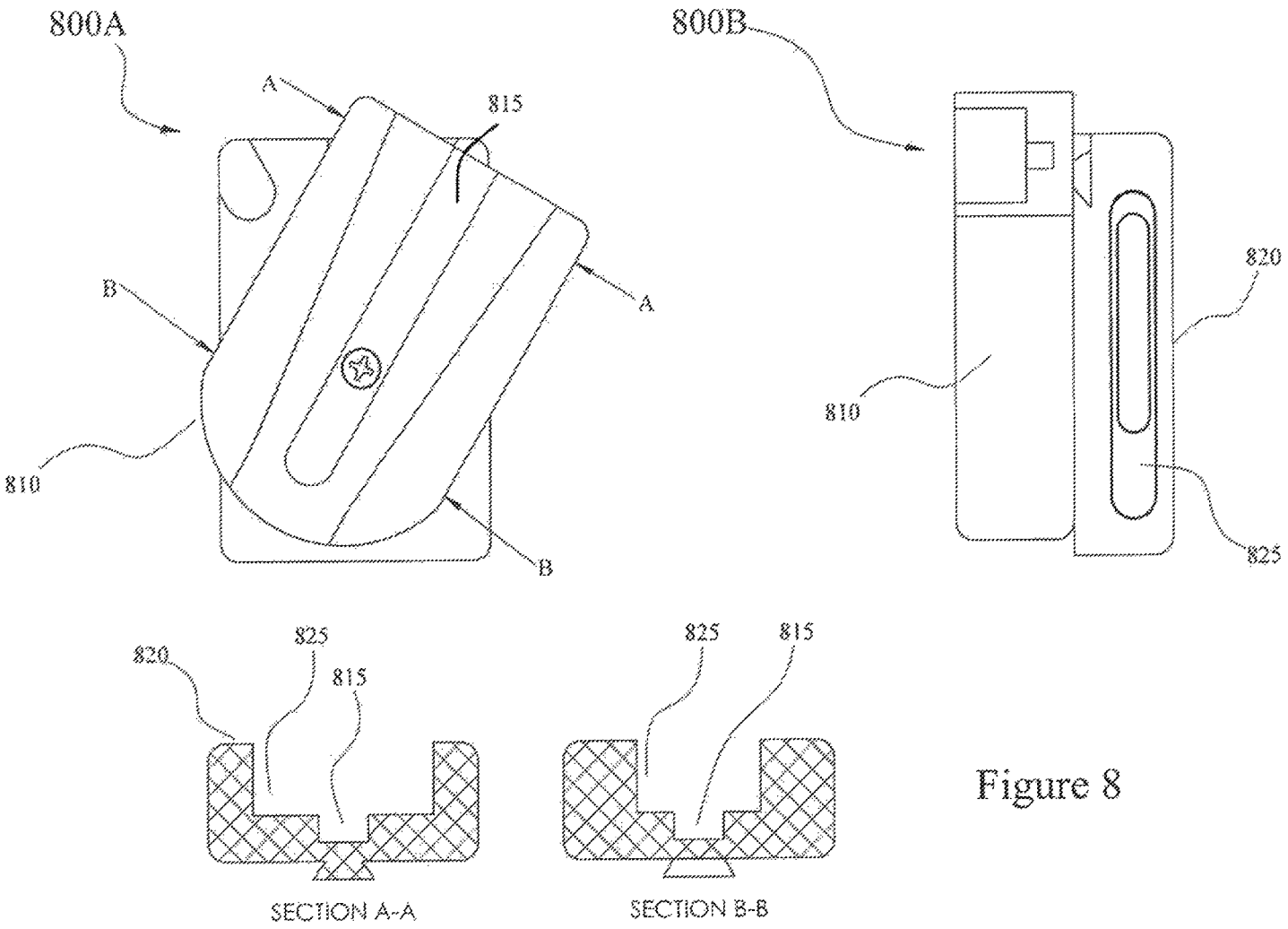
FIG. 8 depicts a slide CYCLER (CYCLER) according to an embodiment of the invention.

Now referring to FIG. 8 there are depicted first and second views 800A and 800B of a CYCLER according to an embodiment of the invention. The CYCLER comprises two components within this embodiment, the CYCLER spine 820 and receiver 810. As with the spine 310 of the MAGRET the CYCLER spine 820 may be made of impact resistant Delrin™, for example, and be designed to permit attachment to a standard police or military style duty belt measuring approximately 2¼" high and ¼" thick or, by deploying an insert, similar to insert 325 of the MAGRET 300 which fits within slot 825, attachment and conversion for use on a plain clothes dress belt such as the BlackHawk CQC carbon fibre belt model 4113PBK measuring approximately 1½" high and ¼" thick or attachment on a MOLLE style tactical vest currently in use by law enforcement and military around the world. Within other embodiments of the invention the CYCLER may be mounted through other fittings that fit the slot 825 in order that the CYCLER may be mount onto not only a wide range of vests, protective wear, equipment etc. but also that the CYCLER may also be attached to a variety of surface mounting systems, e.g. the inside of a police shield or an interior surface of an urban protection vehicle.

The CYCLER spine 820 may be secured to the duty belt by two 8-32 socket head set screws for the Police or Military 2¼" duty belt for example or one 8-32 socket head set screw for the plain clothes duty belt with an insert within the slot 825 within the CYCLER spine 820. In this latter instance the other 8-32 screw secures the insert into the slot 825 within the CYCLER spine 820. As with the MAGRET 300 the selection of Delrin™ as the material also permits the use of the system in cold weather climates where metals would stick to exposed flesh as well as potentially scratch and damage parts of the weapon during use. Similarly, a black colour for the Delrin™ may be chosen to blend in with current material colouring of tactical and police duty equipment as well as providing long service life and durability. Color can be adapted to match operational environment such as described supra in respect of MAGRET 300 which may also include pixelated patterns. The TTS concept exploiting the CYCLER is based upon tactile feedback (feel) such that the user can quickly landmark and use the system. This makes finding the unit based on color flexible such that the receiver 810 may be colour coded according to the firearm or firearms it is intended to work with.

Within an embodiment of the invention the CYCLER spine 820 is machined such that there are three positions for mounting the receiver 810 which attaches to it. The main position is vertical down (VD) but the CYCLER spine 820 can also align the receiver 810 30° to the left or right to permit mounting for both right and left handed shooters. This provides exceptional adaptability to placement on the belt or vest/arm or leg harnesses including those with MOLLE systems. It would be evident that other designs may provide more or less predetermined orientations as well as continuously variable designs.

In order for the CYCLER spine 820 and receiver 810 to handle the stresses and forces exerted during their use a similar round dovetail slot design may be used as with the MAGRET 300 such that pressure applied to the CYCLER spine 820 causes it to press into and hold tighter within the receiver 810. Mounting of the CYCLER spine 820 and receiver 810 in FIG. 8 is achieved through a single 6-32 flat head machine screw to hold the receiver 810 in place and stop it from falling off the CYCLER spine 820 during use or changing angle orientation. Accordingly, the receiver 810 is provided with a single, round, dovetail protrusion on the back surface that fits into one of the three dovetail orientation slots for VD, 30° RH or 30° LH machined into the CYCLER spine 820.

The exposed accessible surface of the receiver 810 is, according to an embodiment of the invention, a slot 815 approximately 0.350" wide and 0.190" deep running along the CYCLER vertical centerline from the top edge of the receiver 810 downwards for approximately 2.544" in which the front sights of the weapon are guided and protected from impact that might cause misalignment or damage during the cycling process of the weapons slide. The left and right walls of the receiver 810 create a tapered region 825 which is wide at the top edge of the receiver 810 and tapers inward to create the required tapering profile as the walls progress down the receiver 810. These tapered walls grip the sides of the weapon as force is applied downward thereby stopping the downward motion of the slide but allowing the frame and barrel of the weapon to continue downward motion that will result in a round of ammunition being loaded into the weapons chamber or breach. This loading or cycling action brings the officers weapon to ready-to-fire status in a matter of seconds with just the use of one hand. The slot 815 and tapered region 825 within receiver 810 are depicted within the cross-sections A-A and B-B.

The receiver 810 depicted with a wide tapered slot permits the receiver 810 to be utilized with a large selection of firearms currently manufactured and on the market without having to change parts or customize the receiver 810 to a specific weapon or manufacturer. The tapering of the slot also permits for a gross motor action in finding and using the CYCLER with the semi-automatic firearm. The user must only index one side or part of the opening then follow the motion through as the taper will guide the slide to proper orientation and then grip it, allowing the pistol to be cycled. In some instances, due to particular characteristics of the firearm sights, barrel, slide etc. the receiver 810 may be customized to the firearm or perhaps the user due to a peculiarity of their action.

According to an embodiment of the invention, a user has a CYCLER 800A, 800B, a holster, and a MAGRET 300 upon their belt, and has within their right hand a firearm 170 from which they have just released a magazine 160. The user moves the firearm 170 back to the CYCLER and pushes the slide down into the CYCLER such that it is retained and the user's continued action on the firearm 170 cycles the action. The user brings the firearm 170 forward, which is now cycled with the slide pushed back, and the ejection port is open allowing the user to visually check that the firearm 170 is cleared.

Figure 9:
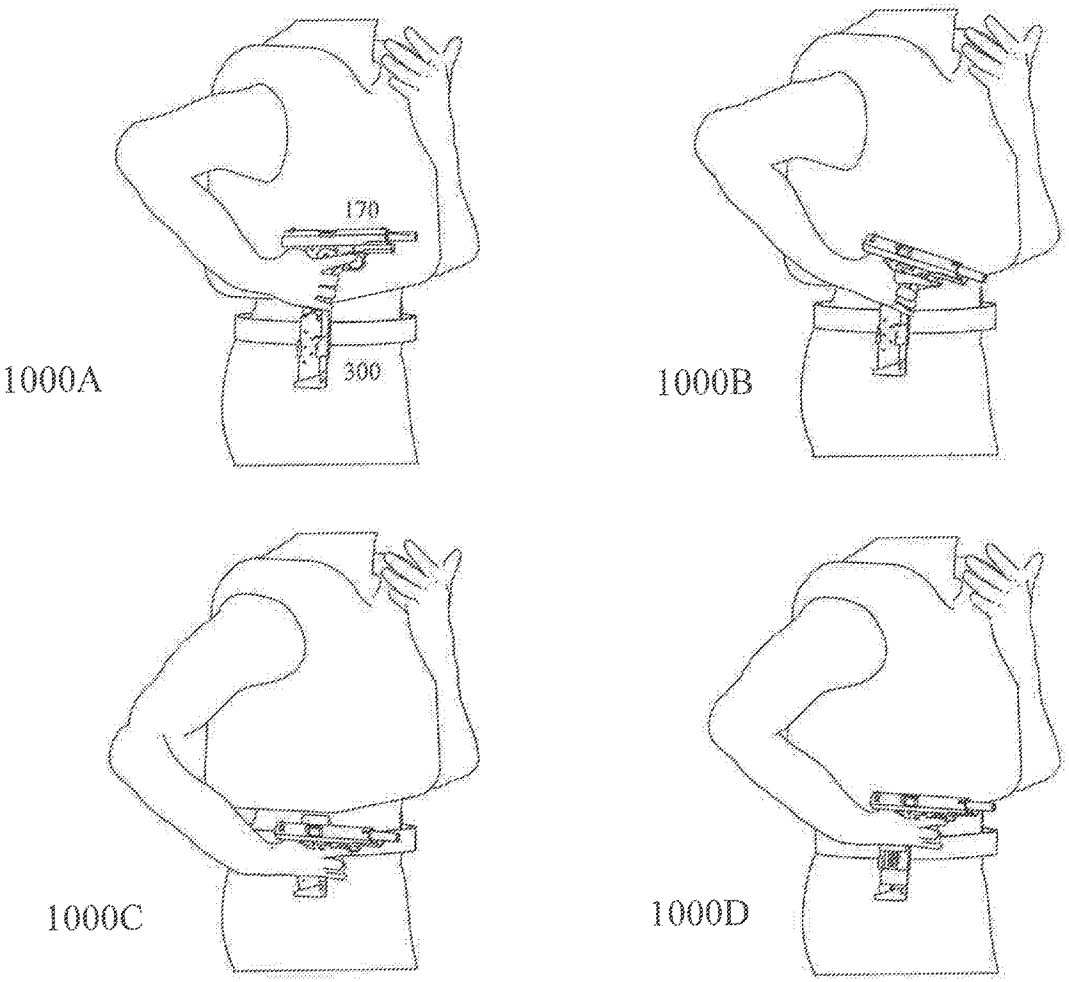
FIG. 9 depicts a user using a MAGRET according to an embodiment of the invention with one-hand.

FIG. 9 depicts a user using a MAGRET according to an embodiment of the invention with one-hand in first to fourth images 1000A to 1000D respectively. In first image 1000A the user brings their firearm 170 to the MAGRET 300, then in second image 1000B they engage the cover with the bottom edge of the firearm handle lifting it before pushing the well in the firearm handle down over the magazine. As depicted in third image 1000C as they continue pushing down they pivot the firearm away from their bodies removing it from the retaining arms of the MAGRET 300 until the magazine is inserted into the firearm. Next in fourth image 1000D the user brings the firearm with the newly installed magazine back to the top of the MAGRET 300 allowing them to push the firearm down against the cover of the MAGRET 300 to ensure the magazine is fully seated.

Figure 10:
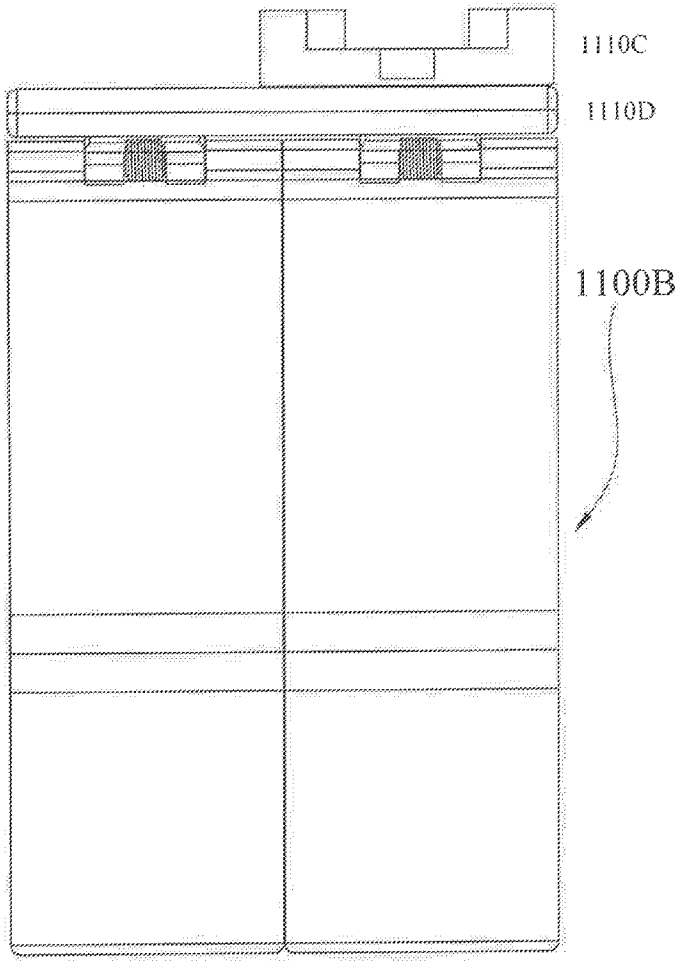
FIG. 10 depicts a dual MAGRET with integral receiver according to an embodiment of the invention.
Figure 10:
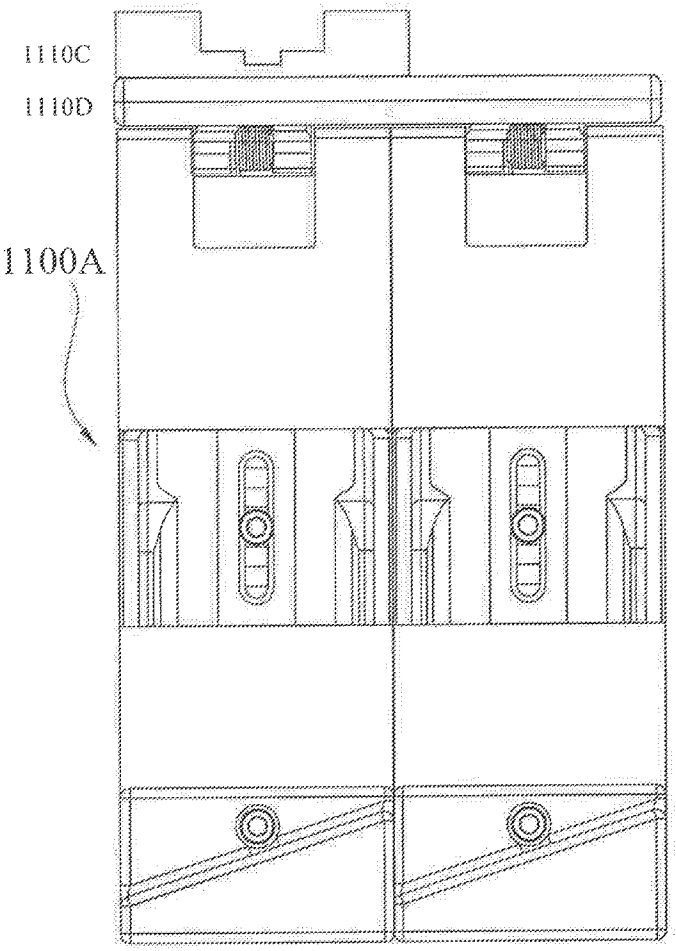

Now referring to FIG. 10, there is depicted a dual MAGRET assembly with integral receiver according to an embodiment of the invention. As depicted in first and second views 1100A and 1100B respectively there are a pair of MAGRET, first and second MAGRET 1110A and 1110B, that share a common cover 1110D atop of which is a receiver 1110C such as described supra in respect of receiver 810 in FIG. 8. Accordingly, the user of the dual MAGRET assembly has available two spare magazines when loaded into the dual MAGRET assembly whilst still being able to use the receiver 1110C to cycle the slide of the firearm and the other portion of the cover 1110D to ensure a newly loaded magazine is seated into the handle of the firearm.

Figure 11:
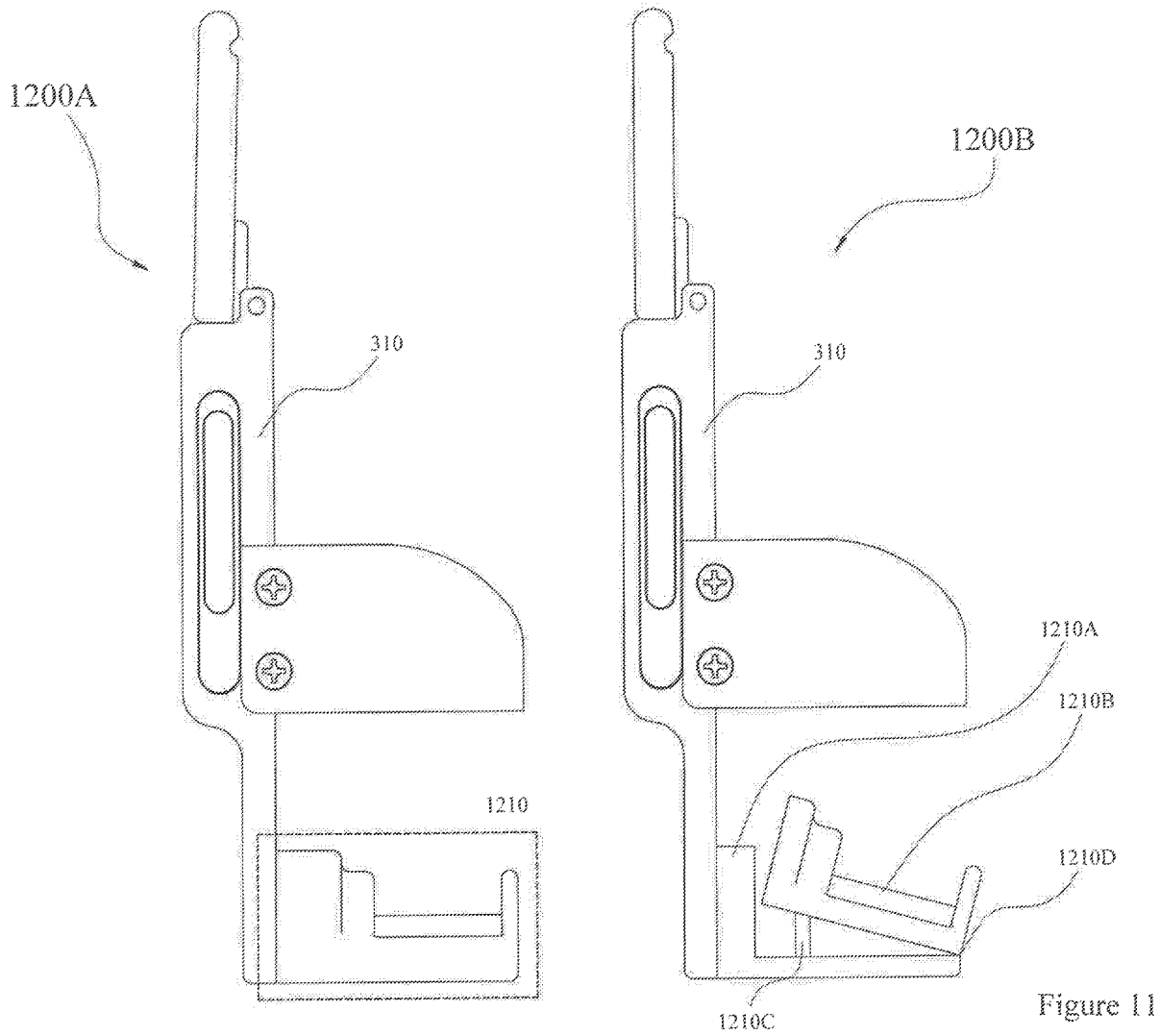
FIG. 11 depicts a MAGRET with sprung loaded base according to an embodiment of the invention.

Now referring to FIG. 11 there is depicted a MAGRET with sprung loaded based according to an embodiment of the invention. As depicted in first view 1200A a MAGRET spine 310 has attached a base 1210 which is depicted in "closed" position as if the magazine were loaded but the magazine has been omitted for clarity. Subsequently, in use a user is loading the magazine into a firearm with the motion defined above wherein the user in pushing the firearm down over magazine has also started an arcuate motion pivoting the top of the firearm away from their body. Accordingly, in the embodiment of the invention described supra in respect of FIGS. 3 through 7 this action pivots the magazine off the base 330 of MAGRET 300. In contrast as depicted within FIG. 11 the base 1210 comprises upper and lower sections 1210A and 1210B respectively which are coupled via a pivot 1210D at one end and have a spring 1210C mounted between them at the other end towards the spine 310. Accordingly, as the user pivots the magazine then the upper section 1210A pivots away with it. Optionally, the spring 1210C may be replaced with another element providing pressure to maintain the upper section 1210A in contact with the magazine or removed wherein contact between the upper section 1210A and magazine is maintained through the pressure applied to the firearm and magazine by the user in performing the action.

Whilst embodiments of the invention in respect of the MAGRET have been described from the viewpoint of an assembly in respect of FIGS. 3 through 11 it would be evident to one skilled in the art that multiple elements of the assembly may be machined and/or molded as a single piece-part to which other elements may be assembled. Accordingly, it would be evident that the spine and base may be formed together or that the spine, base and retainer arms may be formed together such that design aspects of the retainer arms provide the required degree of flexibility even if formed from a material otherwise considered to be resilient.

The foregoing disclosure of the exemplary embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. A device comprising:

a spine;

a cover attached to the spine and configured to at least partially cover a top portion of the spine; and a retainer configured to retain a magazine of a firearm, the retainer being attached to the spine, wherein the retainer comprises at least a first groove tapering from a first width of the retainer towards a pivotal attachment between the cover and the spine to a second width of the retainer towards a front edge of the cover, wherein the second width of the retainer is less than a width of a slide of a firearm such that the slide of the firearm undergoes a first movement when a user pushes a muzzle end of the slide of the firearm into the retainer to cycle a slide action of the slide of the firearm.

2. The device according to claim 1 further comprising;

at least a second groove aligned with the first groove and configured to receive a sight of the firearm and allow the sight to move along the retainer without the sight engaging a surface of the retainer.

* * * * *